US008297022B2

(12) United States Patent
Cudney et al.

(10) Patent No.: US 8,297,022 B2
(45) Date of Patent: Oct. 30, 2012

(54) PORTABLE VAPOR CONTAINMENT STRUCTURE

(75) Inventors: Joseph Cudney, Flowery Branch, GA (US); Jeffrey Hillson, Denver, CO (US)

(73) Assignee: Parsons Corporation, Pasadena, CA (US)

( * ) Notice: Subject to any disclaimer, the term of this patent is extended or adjusted under 35 U.S.C. 154(b) by 1101 days.

(21) Appl. No.: 12/197,872

(22) Filed: Aug. 25, 2008

(65) Prior Publication Data

US 2012/0146302 A1 Jun. 14, 2012

Related U.S. Application Data

(62) Division of application No. 11/564,196, filed on Nov. 28, 2006, now Pat. No. 7,431,686.

(51) Int. Cl.
*B09B 1/00* (2006.01)

(52) U.S. Cl. ..... 52/651.1; 52/63; 588/249

(58) Field of Classification Search ..... 52/651.1, 52/63; 588/249, 16, 249.5, 250–260; 405/129.57; 220/62.11; 110/237; 206/528; 280/3, 832, 280/836, 5.3, 6, 155; 86/50
See application file for complete search history.

(56) References Cited

U.S. PATENT DOCUMENTS 4,765,352 A * 8/1988 Strieter ..... 134/99.1
4,774,974 A * 10/1988 Teter ..... 134/110
4,964,899 A * 10/1990 Griffis ..... 55/356
4,972,688 A * 11/1990 Cares et al. ..... 68/18 R
5,062,871 A * 11/1991 Lemon, III ..... 55/385.2
5,067,504 A * 11/1991 Coleman, III ..... 134/172
5,080,701 A * 1/1992 Howard et al. ..... 55/356
5,277,654 A * 1/1994 Fenn et al. ..... 454/141
5,558,112 A * 9/1996 Strieter ..... 134/103.2
6,383,242 B1 * 5/2002 Rogers et al. ..... 55/385.2
6,749,388 B1 * 6/2004 Schmidt ..... 414/459
7,134,444 B2 * 11/2006 Mintie et al. ..... 135/131
7,406,978 B2 * 8/2008 Mintie et al. ..... 135/131
7,748,508 B2 * 7/2010 Lee et al. ..... 190/18 A
7,918,622 B2 * 4/2011 Whitford ..... 404/6
2009/0314187 A1 * 12/2009 Miller ..... 108/25

OTHER PUBLICATIONS

Design specification—dated Nov. 9, 2004.

* cited by examiner

*Primary Examiner* — Mark Wendell

(74) *Attorney, Agent, or Firm* — Denton L. Anderson; Sheldon Mak & Anderson PC

(57) ABSTRACT

A portable vapor containment structure has a support frame, at least three wheels to roll the support frame about the ground and wheel retractors for retracting each of the wheels so as to allow the frame to be lowered to the ground. Typically, the apparatus further includes an enclosed vapor containment compartment mounted upon the support frame attached to the support frame. The vapor containment compartment has a bottom opening located within the perimeter of the support frame.

10 Claims, 5 Drawing Sheets

PORTABLE VAPOR CONTAINMENT STRUCTURE

RELATED APPLICATIONS

This application is a divisional application of U.S. patent application Ser. No. 11/564,196, filed Nov. 28, 2006, now U.S. Pat. No. 7,431,686, entitled PORTABLE VAPOR CONTAINMENT STRUCTURE, the entirety of which is incorporated herein by reference.

FIELD OF THE INVENTION

This invention relates generally to apparatuses and methods for handling toxic or explosive material, such as mortar and artillery shells.

BACKGROUND

The handling of war materials, such as unexploded artillery shells and mortar shells, is a difficult and dangerous task. The handling of such war materials where the war materials may contain toxic materials is especially difficult and dangerous. Not only might the item of war material explode during the handling process, but the toxic material may escape in one of many ways, thereby threatening not only personnel engaged in the handling of the war materials, but personnel many miles away from where the war materials are being handled.

It is increasingly required that the handling of toxic or explosive materials be conducted within a containment structure designed to withstand the inadvertent explosion of the item of war material and to prevent the airborne dispersal of the toxic material within the item of war material. The task of enclosing each item of war material within a containment structure while investigating and handling that item of war material can be cumbersome and very expensive.

Rather than build containment structures around each item of war materials to be handled, some contractors have constructed a limited number of movable structures, and have physically moved those movable containment structures about the area from one item of war material to another. Unfortunately, even this procedure is cumbersome and expensive. Because the containment structures are large and built strong enough to withstand the blast from an inadvertently exploded item of war materials, very large cranes and other heavy equipment is required to move these containment structures around.

Accordingly, there is a need for new apparatuses and methods for handling items of toxic or explosive materials which avoids the aforementioned in the prior art.

SUMMARY

The invention satisfies this need. The invention is an apparatus and a method of using that apparatus to handle items of toxic or explosive material. The apparatus comprises (a) a support frame having an upper side, a lower side and a perimeter, the perimeter defining a central opening; (b) at least three wheels attached to the support frame, the wheels being operatively adapted to facilitate lateral movement of the support frame across a surface; and (c) wheel retractors for retracting each of the wheels upwardly with respect to the support frame such that the support frame is raisable and lowerable between (i) a raised position wherein the support frame is disposed at a first elevation and can be laterally moved along a surface using the attached wheels, and (ii) a lowered position wherein the support frame is disposed at a second elevation which is lower than the first elevation.

Typically, the apparatus further comprises an enclosed containment compartment attached to the upper side of the support frame. The containment compartment has a bottom opening which is in communication with the central opening in the support frame.

A method of using the above apparatus for handling items of toxic or explosive material comprises the steps of (a) moving the portable containment structure along the surface of the toxic or explosive material location using the wheels on the portable containment structure until the central opening in the perimeter of the support frame is disposed over the item of toxic or explosive material; (b) retracting the wheels so that the frame is disposed in close proximity to the surface; and (c) handling the item of toxic or explosive material within the enclosed containment compartment.

DRAWINGS

DETAILED DESCRIPTION

Figure 1:
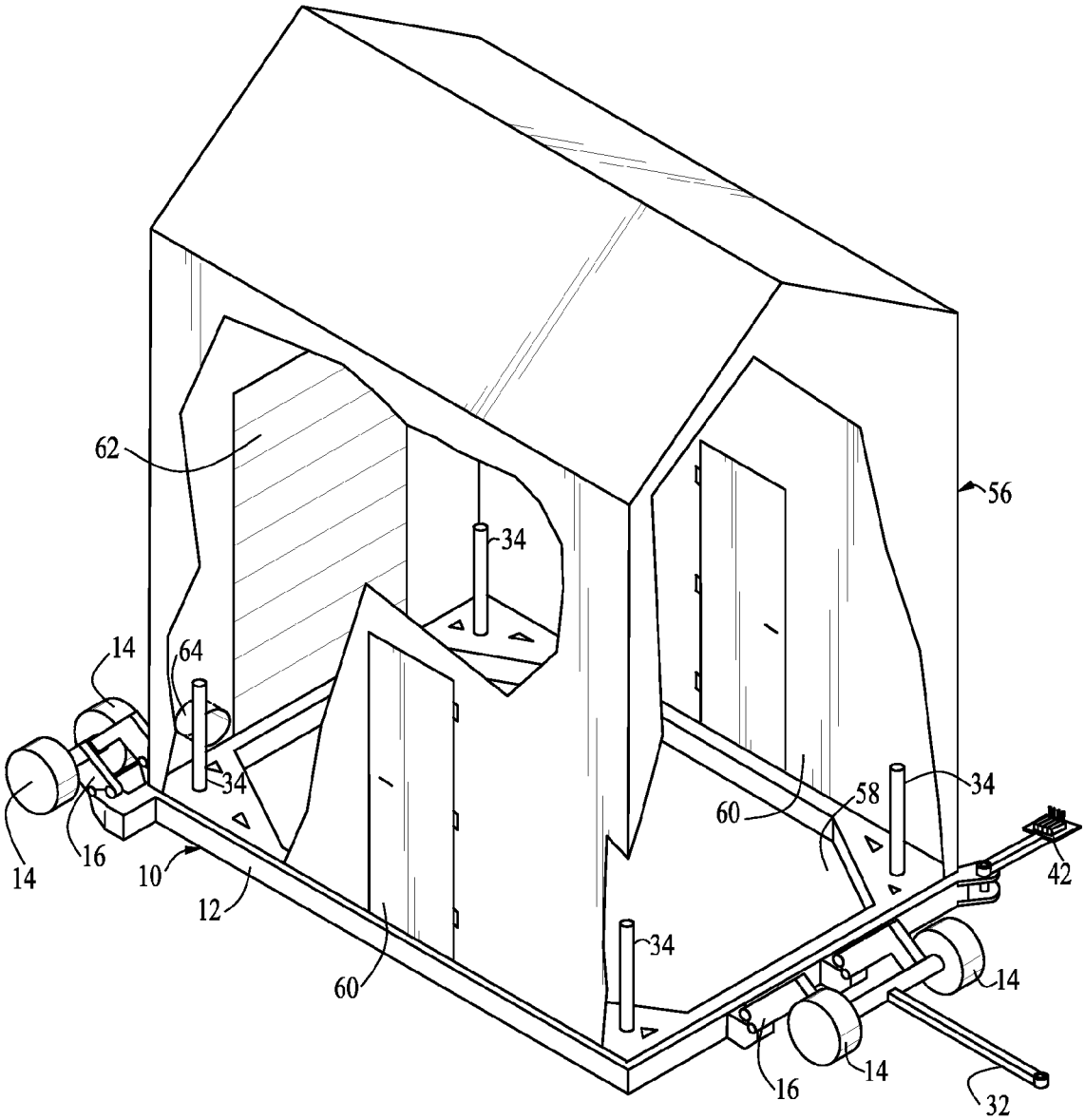
FIG. 1 is a perspective view of a portable containment structure having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is an apparatus 10 suitable for use in a portable containment structure. The apparatus 10 comprises a support frame 12, at least three wheels 14 and wheel retractors 16.

The support frame 12 has an upper side 18, a lower side 20 and a perimeter 22. The perimeter 22 defines a central opening 24. In a typical embodiment, the support frame 12 is made from steel. In a typical embodiment, the support frame 12 is rectangular having side members 26 of about 40 feet in length and end members 28 of about 30 feet in length.

The at least three wheels 14 are attached to the support frame 12 and are operatively adapted to facilitate lateral movement of the support frame 12 across a surface 30, such as across the surface 30 of the ground in a toxic or explosive material location. Typically, the frame 12 is supported by at least four wheels 14. In the embodiment illustrated in the drawings, the apparatus 10 comprises six wheels 14, four located at the rear of the support frame 12 and two directionally variable wheels 14 (used for steering the support frame 12) located at the forward end of the support frame 12. This embodiment further comprises a tow bar 32 attached to the forward end of the frame to facilitate the towing of the frame across the surface 30.

The wheel retractors 16 provide the ability for retracting each of the wheels 14 upwardly with respect to the support frame 12, such that the support frame 12 is raisable and lowerable between (i) a raised position wherein the support frame 12 is disposed at a first elevation and can be laterally moved along a surface 30 using the attached wheels 14, and (ii) a lowered position wherein the support frame 12 is disposed at a second elevation which is lower than the first elevation.

In the embodiment illustrated in the drawings, the wheel retractors 16 comprise a plurality of hydraulic jacks 34 spaced around the perimeter 22 of the support frame 12 and disposed vertically so as to be alternatively raisable and lowerable between (i) a retracted position wherein a lowermost portion of each jack is disposed proximate to the support frame 12, and (ii) an extended position wherein the lowermost portion of each jack is disposed spaced apart below the support frame 12.

Figure 4:
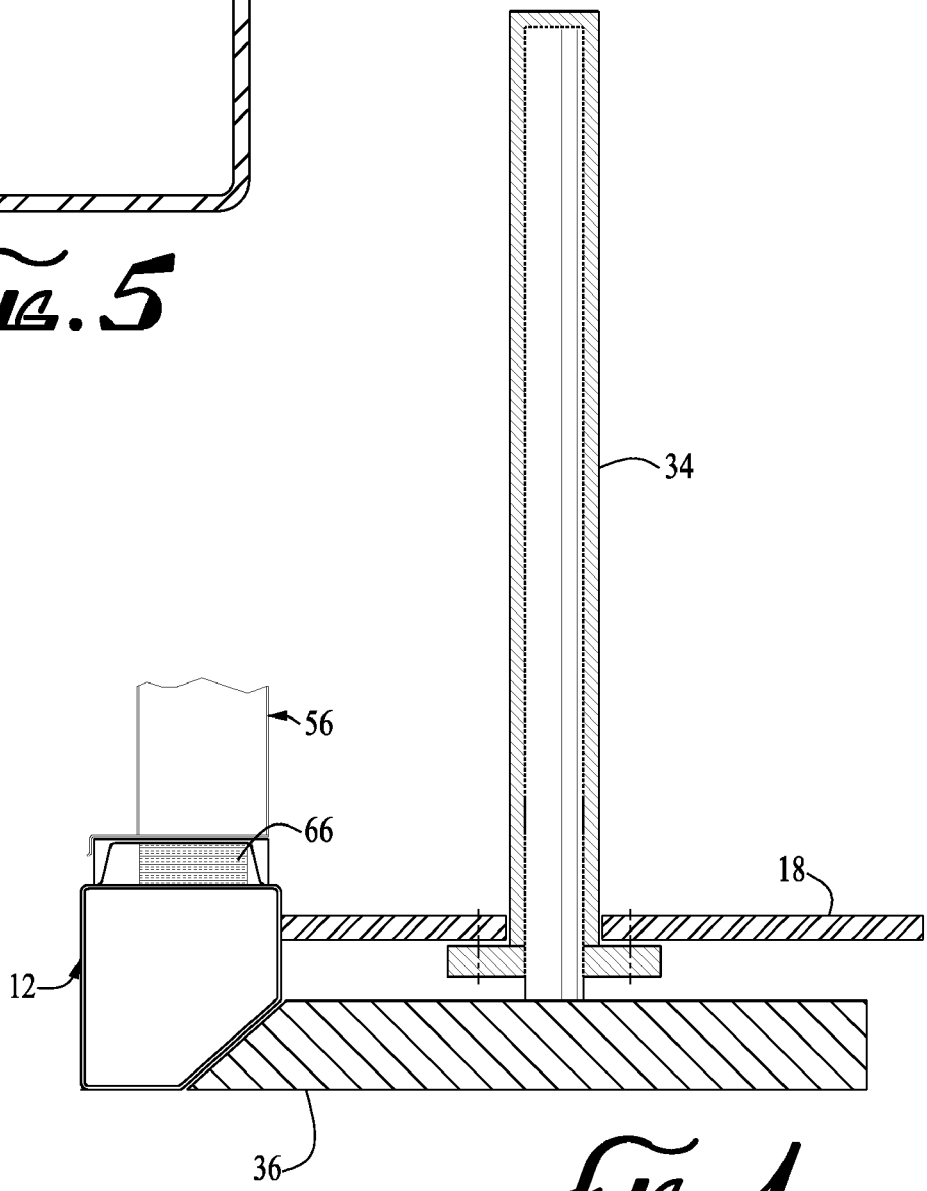
FIG. 4 is a detail cross-sectional view of portions of a wheel retractor useful in the portable containment structure illustrated in FIG. 1.

FIG. 4 illustrates in detail a hydraulic jack in its retracted position. At the base of the hydraulic jack is a foot 36 adapted to support the support frame 12 when the hydraulic jack is disposed in its extended position.

Figure 3:
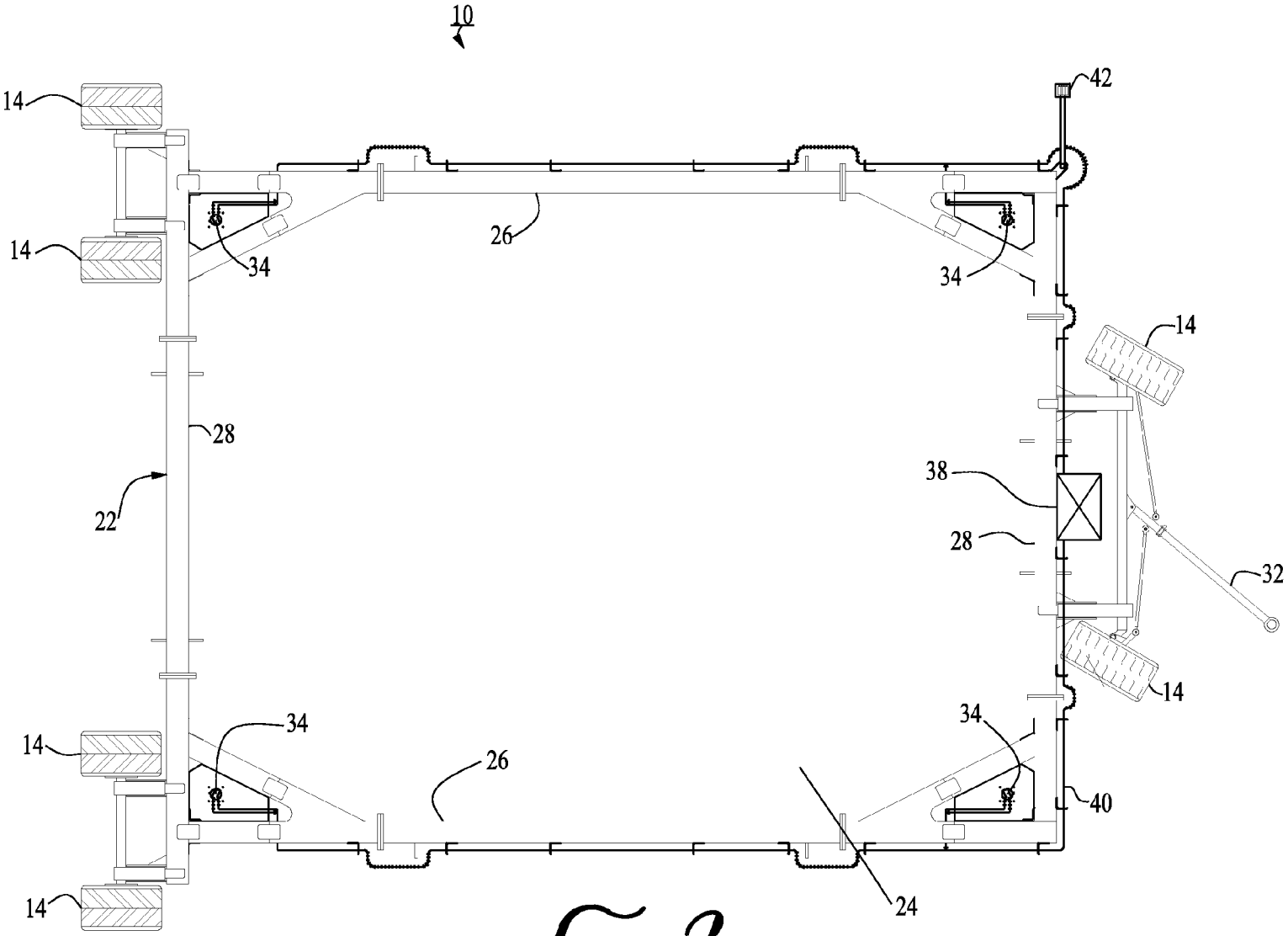
FIG. 3 is a plan view of an apparatus useful in the portable containment structure illustrated in FIG. 1.

In the embodiment illustrated in the drawings, the hydraulic jacks 34 are pressured up by a hydraulic pump 38 disposed at the forward end of the support frame 12. FIG. 3 illustrates hydraulic lines 40 communicating between the hydraulic pump 38 and each of the four hydraulic jacks 34.

Preferably, each of the plurality of hydraulic jacks 34 is operable independently of the other hydraulic jacks 34 via a hydraulic controller 42, such as by the swing arm hydraulic controller 42 illustrated in FIGS. 1 and 3.

In the embodiment illustrated in the drawings, the wheel retractors 16 further comprise rotatable plates 44 attached to each wheel 14 to alternatively pivot the wheels 14 between (i) a first position wherein the support frame 12 is disposed in the raised position, and (ii) a second position wherein the support frame 12 is allowed to assume the lowered position.

Figure 2:
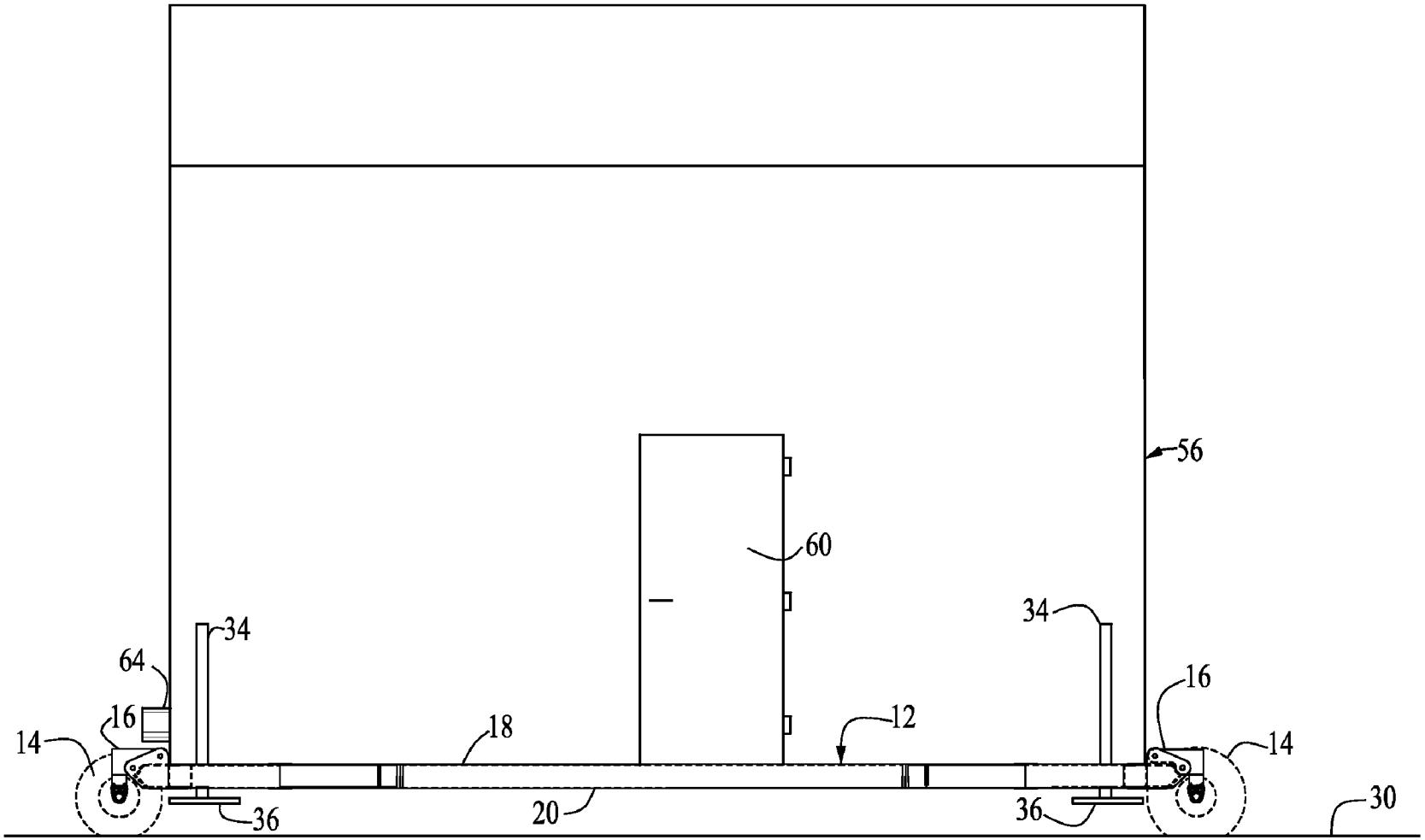
FIG. 2 is a side view of the portable containment structure illustrated in FIG. 1.
Figure 6:
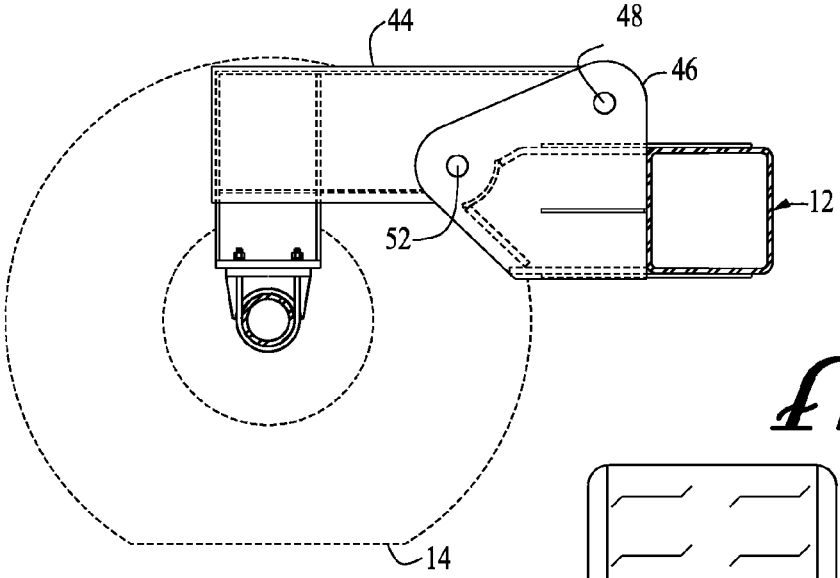
FIG. 6 is a detail cross-sectional view of additional portions of wheel retractors useful in the portable containment structure illustrated in FIG. 1, wherein the wheels are illustrated in the lowered position.
Figure 8:
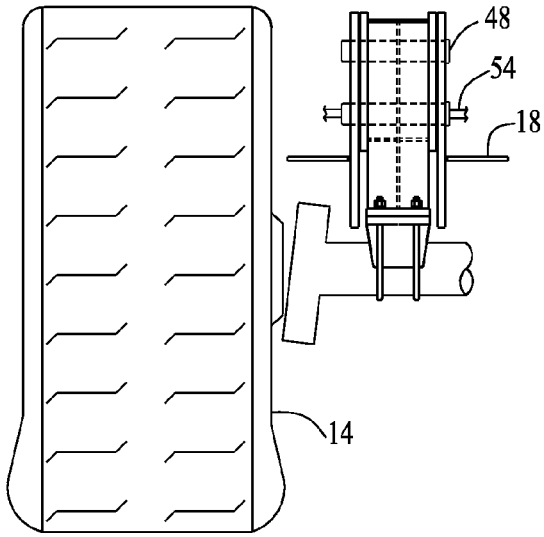
FIG. 8 is a cross-sectional detail view of that portion of the wheel retractors illustrated in FIG. 6.

When the support frame 12 is in the raised position, FIGS. 2, 6 and 8 illustrate that the lowermost portion of the wheels 14 are disposed below the support frame 12. Each wheel 14 is attached to the support frame 12 by a rotatable plate 44. One end of each rotatable plate 44 is attached to the hub of a wheel 44 and an opposite end of each rotatable plate 44 is pivotally attached to the support frame 12. When the support frame 12 is in the raised position, the rotatable plate 44 can be locked with respect to the support frame 12 so that it cannot rotate with respect to the frame 12.

Figure 7:
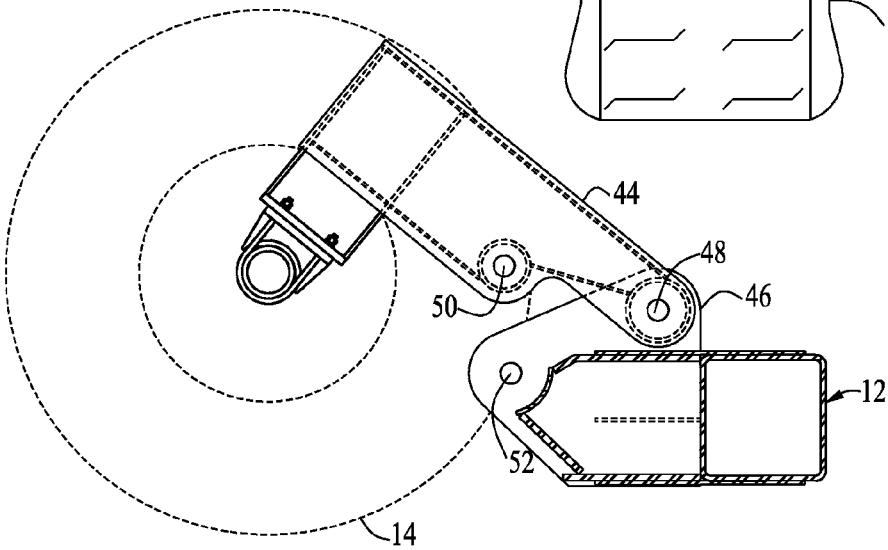
FIG. 7 is a detail cross-sectional view of additional portions of wheel retractors useful in the portable containment structure illustrated in FIG. 1, wherein the wheels are shown in the raised position.

As illustrated in FIGS. 1 and 7, when it is desired to move the support frame 12 to the lowered position, the rotatable plate 44 is unlocked with respect to the support frame 12, thereby allowing the rotatable plate 44 to pivot with respect to the support frame 12, and allowing the support frame 12 to be moved to the lowered position.

FIGS. 6 and 8 illustrate in detail one of the wheels 14 in a locked and lowered position, such that the wheel supports the support frame 12 above the surface 30. The wheel is retained to the frame by a rotatable plate 44. The rotatable plate 44 is rotatably attached to an attachment plate on the support frame 12, and rotates about an axis of rotation 48. The rotatable plate 44 defines a rotatable plate aperture 50 which, when the wheel 14 is in the lowered position, is aligned with an attachment plate aperture 52 in the attachment plate. When the wheel is in the lowered position, and the rotatable plate aperture 50 and the attachment plate aperture 52 are aligned, the rotatable plate 44 can be locked in place by a locking pin 54 disposed within the rotatable plate aperture 50 and the attachment plate aperture 52.

FIG. 7 illustrates the wheel 14 shown in FIG. 6 disposed within a retracted position. The locking pin 54 has been removed from the rotatable plate aperture 50 and the attachment plate aperture 52, allowing the rotatable plate 44 to rotate about the axis of rotation 48 in the attachment plate.

As can be seen in the drawings, when the support frame 12 is disposed in its lowered position, with the feet 36 of the hydraulic jacks 34 disposed in a fully retracted position (as illustrated in FIG. 4), the support frame 12 can be disposed in contact with the surface 30.

Where the apparatus 10 is to be used in a portable containment structure, an enclosed containment compartment 56 is attached to the upper side 18 of the support frame 12 as illustrated in FIGS. 1 and 2. The containment compartment 56 has a bottom opening 58 which is in communication with the central opening 24 in the support frame 12.

The containment compartment 56 is typically large enough to allow one or more workers to comfortably work within the containment compartment 56. In a typical embodiment, the containment compartment 56 is rectangular having side walls about 40 feet in length, end walls about 30 feet in length and a ceiling having a minimum height of about 17. In the embodiment illustrated in the drawings, access to the containment compartment 56 is provided by a pair of side doors 60 and a roll-up door 62 disposed at the rear of the containment compartment 56.

A port 64 is typically disposed near the base of the containment compartment 56 to facilitate the drawing of a vacuum on the containment compartment 56 during operation.

The containment compartment 56 is typically made from steel of such strength and thickness to withstand the inadvertent explosion of ordinance being handled within the containment compartment 56. In a typical embodiment, the containment compartment 56 is made from 14-gauge steel.

Figure 5:
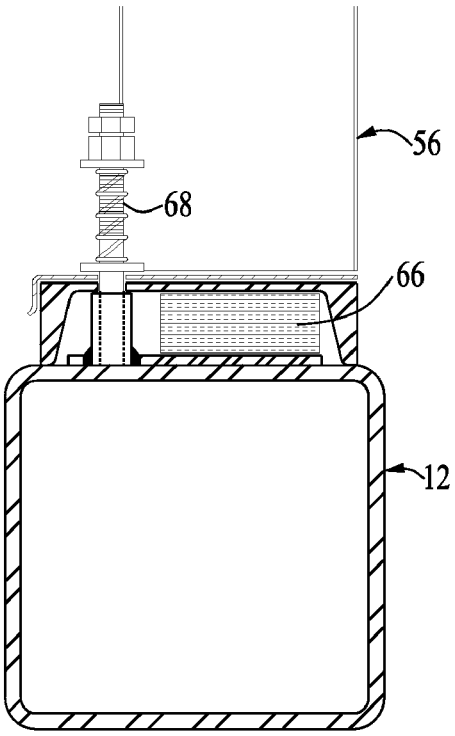
FIG. 5 is a detail cross-sectional view of the attachment of a containment compartment to a support frame in the portable containment structure illustrated in FIG. 1.

FIG. 5 illustrates a typical attachment of the containment compartment 56 to the support frame 12. As illustrated in FIG. 5, a resilient spacer 66 can be disposed between the support frame 12 and the base of the containment compartment walls to cushion the attachment and to allow a certain degree of play between the containment compartment 56 and the support frame 12. Such degree of play is further provided by the use of one or more attachment spring bolts 68.

The portable containment structure can be conveniently used for handling an item of toxic or explosive material disposed at the surface 30 of a toxic or explosive material location by the following steps: (a) moving the portable containment structure along the surface 30 of the toxic or explosive material location using the wheels 14 on the portable containment structure until the central opening 24 in the perimeter 22 of the support frame 12 is disposed over the item of toxic or explosive material; (b) retracting the wheels 14 so that the frame is disposed in close proximity to the surface 30; and (c) handling the item of toxic or explosive material within the enclosed containment compartment 56.

Typically, a negative pressure is drawn on the enclosed containment compartment 56 prior to the handling of the item of toxic material within the enclosed containment compartment 56 via the port 64 disposed near the base of the containment compartment 56. The drawing of a vacuum minimizes the chances of toxic gases emanating from within the enclosed containment compartment 56.

The invention provides an improved apparatus and method for handling items of toxic or explosive materials. Unlike prior art apparatuses and methods, the invention provides a containment structure which can be readily moved about an area containing toxic or explosive materials without requiring the expense of having to repeatedly assemble and disassemble containment structures over individual items of war materials and without having to use costly heavy equipment to move a single containment structure from site to site about the area. The invention provides a portable containment structure which is neither cumbersome, expensive or time-consuming to operate.

Having thus described the invention, it should be apparent that numerous structural modifications and adaptations may be resorted to without departing from the scope and fair meaning of the instant invention as set forth hereinabove.

What is claimed is:

1. A portable containment structure comprising:

(a) a support frame having an upper side, a lower side and a perimeter, the perimeter defining a central opening;

(b) an enclosed containment compartment attached to the upper side of the support frame, the containment compartment having a bottom opening which is in communication with the central opening in the support frame;

(c) at least three wheels attached to the support frame, the wheels being operatively adapted to facilitate lateral movement of the support frame across a surface; and (d) wheel retractors for retracting each of the wheels upwardly with respect to the support frame which alternatively raise and lower the support frame between (i) a raised position wherein the support frame is disposed at a first elevation and can be laterally moved along a surface using the attached wheels, and (ii) a lowered position wherein the support frame is disposed at a second elevation which is lower than the first elevation and wherein the support frame is disposed in contact with the surface, each wheel retractor comprising a rotatable plate attached at one end to the hub of a wheel and pivotally attached at an opposite end to the support frame, such that each wheel can alternatively be rotated between (i) a first position wherein the support frame is disposed in the raised position and (ii) a second position wherein the support frame is allowed to assume the lowered position.

2. The portable containment structure of claim 1 wherein the wheel retractors further comprise a plurality of hydraulic jacks spaced around the perimeter of the support frame and disposed vertically so as to alternatively be raisable and lowerable between (i) a retracted position wherein a lowermost portion of each jack is disposed proximate to the support frame, and (ii) an extended position wherein the lowermost portion of each jack is disposed spaced apart below the support frame.

3. The portable containment structure of claim 2 wherein each of the plurality of hydraulic jacks is operable independently of the other hydraulic jacks.

4. A portable containment structure comprising:

(a) a support frame having an upper side, a lower side and a perimeter, the perimeter defining a central opening;

(b) an enclosed containment compartment attached to the upper side of the support frame, the containment compartment having a bottom opening which is in communication with the central opening in the support frame;

(c) at least four wheels attached to the support frame, the wheels being operatively adapted to facilitate lateral movement of the support frame across a surface; and (d) wheel retractors for retracting each of the wheels upwardly with respect to the support frame such that the support frame is raisable and lowerable between (i) a raised position wherein the support frame is disposed at a first elevation and can be laterally moved along a surface using the attached wheels, and (ii) a lowered position wherein the support frame is disposed at a second elevation which is lower than the first elevation and wherein the frame is disposed in contact with the surface, each wheel retractor comprising a retractable plate attached at one end to the hub of a wheel and pivotally attached at an opposite end to the support frame, such that each wheel can alternatively be rotated between (i) a first position wherein the support frame is disposed in the raised position, and (ii) a second position wherein the support frame is allowed to assume the lowered position, the wheel retractors further comprising a plurality of hydraulic jacks spaced around the perimeter of the support frame and disposed vertically so as to alternatively be raisable and lowerable between (i) a retracted position wherein a lowermost portion of each jack is disposed proximate to the support frame, and (ii) an extended position wherein the lowermost portion of each jack is disposed spaced apart below the support frame, each of the plurality of hydraulic jacks being operable independently of the other hydraulic jacks.

5. The portable containment structure of claim 4 wherein each of the plurality of hydraulic jacks is operable independently of the other hydraulic jacks.

6. A portable containment structure comprising:

(a) a support frame having an upper side, a lower side and a perimeter, the perimeter defining a central opening;

(b) an enclosed containment compartment made of steel of such strength and thickness to withstand the inadvertent explosion of ordinance being handled within the containment compartment, the containment compartment being attached to the upper side of the support frame, the containment compartment having a bottom opening which is in communication with the central opening in the support frame;

(c) at least four wheels attached to the support frame, the wheels being operatively adapted to facilitate lateral movement of the support frame across a surface;

(d) wheel retractors for retracting each of the wheels upwardly with respect to the support frame such that the support frame is raisable and lowerable between (i) a raised position wherein the support frame is disposed at a first elevation and can be laterally moved along a surface using the attached wheels, and (ii) a lowered position wherein the support frame is disposed at a second elevation which is lower than the first elevation and wherein the support frame is disposed in contact with the surface, each wheel retractor comprising a retractable plate attached at one end to the hub of a wheel and pivotally attached at an opposite end to the support frame, such that each wheel can alternatively be rotated between (i) a first position wherein the support frame is disposed in the raised position, and (ii) a second position wherein the support frame is allowed to assume the lowered position, the wheel retractors further comprising a plurality of hydraulic jacks spaced around the perimeter of the support frame and disposed vertically so as to alternatively be raisable and lowerable between (i) a retracted position wherein a lowermost portion of each jack is disposed proximate to the support frame, and (ii) an extended position wherein the lowermost portion of each jack is disposed spaced apart below the support frame, each of the plurality of hydraulic jacks being operable independently of the other hydraulic jacks.

7. A portable containment structure comprising:

(a) a support frame having an upper side, a lower side and a perimeter, the perimeter defining a central opening;

(b) an enclosed containment compartment attached to the upper side of the support frame, the containment compartment having a bottom opening which is in communication with the central opening in the support frame;

(c) at least three wheels attached to the support frame, the wheels being operatively adapted to facilitate lateral movement of the support frame across a surface; and (d) means for retracting each of the wheels upwardly with respect to the support frame and for alternatively raising and lowering the support frame between (i) a raised position wherein the support frame is disposed at a first elevation and can be laterally moved along a surface using the attached wheels, and (ii) a lowered position wherein the support frame is disposed at a second elevation which is lower than the first elevation and wherein the support frame is disposed in contact with the surface.

8. The portable containment structure of claim 7 wherein the means for retracting each of the wheels upwardly with respect to the support frame and for alternatively raising and lowering the support frame comprises a plurality of wheel retractors, each wheel retractor having a rotatable plate attached at one end to the hub of a wheel and pivotally attached at an opposite end to the support frame, such that each wheel can alternatively be rotated between (i) a first position wherein the support frame is disposed in the raised position and (ii) a second position wherein the support frame is allowed to assume the lowered position.

9. The portable containment structure of claim 7 wherein the means for retracting each of the wheels upwardly with respect to the support frame and for alternatively raising and lowering the support frame comprises a plurality of hydraulic jacks spaced around the perimeter of the support frame and disposed vertically so as to alternatively be raisable and lowerable between (i) a retracted position wherein a lowermost portion of each jack is disposed proximate to the support frame, and (ii) an extended position wherein the lowermost portion of each jack is disposed spaced apart below the support frame.

10. The portable conainment structure of claim 7 wherein the means for retracting each of the wheels upwardly with respect to the support structure and for alternatively raising and lowering the support frame comprises (i) a plurality of wheel retractors, each wheel retractor having a rotatable plate attached at one end to the hub of a wheel and pivotally attached at an opposite end to the support frame, such that each wheel can alternatively be rotated between (A) a first position wherein the support frame is disposed in the raised position and (B) a second position wherein the support frame is allowed to assume the lowered position; and (ii) a plurality of hydraulic jacks spaced around the perimeter of the support frame and disposed vertically so as to alternatively be raisable and lowerable between (A) a retracted position wherein a lowermost portion of each jack is disposed proximate to the support frame, and (B) an extended position wherein the lowermost portion of each jack is disposed spaced apart below the support frame.

* * * * *